US006482083B1

(12) United States Patent
Nilsson

(10) Patent No.: US 6,482,083 B1
(45) Date of Patent: Nov. 19, 2002

(54) METHOD AND DEVICE FOR VENTILATING A SO CALLED CLEAN ROOM

(75) Inventor: Agne Nilsson, Phinikaria Village (SE)

(73) Assignee: Johnson Medical Development Pte. Ltd., Singapore (SG)

( * ) Notice: Subject to any disclaimer, the term of this patent is extended or adjusted under 35 U.S.C. 154(b) by 0 days.

(21) Appl. No.: 09/857,156

(22) PCT Filed: Dec. 1, 1999

(86) PCT No.: PCT/SE99/02236

§ 371 (c)(1),
(2), (4) Date: Sep. 24, 2001

(87) PCT Pub. No.: WO00/32150

PCT Pub. Date: Jun. 8, 2000

(30) Foreign Application Priority Data

Dec. 2, 1998 (SE) ..... 9804161

(51) Int. Cl.[7] ..... F24F 3/16
(52) U.S. Cl. ..... 454/187; 454/252
(58) Field of Search ..... 454/187, 339, 454/341, 237, 354, 251, 252; 55/385.2

(56) References Cited

U.S. PATENT DOCUMENTS 4,267,769 A * 5/1981 Davis et al. ..... 454/187
5,830,058 A * 11/1998 Rosjo ..... 454/187
5,858,041 A * 1/1999 Luetkemeyer ..... 55/385.2

FOREIGN PATENT DOCUMENTS

| | | | | |
|---|---|---|---|---|
| DE | 23 56 780 | * | 5/1975 | 454/187 |
| DE | 142 382 | * | 6/1980 | 454/187 |
| DE | 42 09 297 | * | 9/1993 | 454/187 |
| JP | 4-135647 | * | 5/1992 | 454/187 |
| SU | 176881 | * | 10/1992 | 454/187 |

* cited by examiner

*Primary Examiner*—Harold Joyce
(74) *Attorney, Agent, or Firm*—Mathews, Collins, Shepherd & McKay, P.A.

(57) ABSTRACT

A method and a device for ventilation of a room with walls (11) and a ceiling (10), clean air being conducted at least to a portion of the room from the ceiling through a first air stream (12), and air being exhausted through first discharge openings (15) provided in the walls (11) of the room. Air contained in a second air stream (13) along at least one wall (11) is exhausted from the room through at least a second discharge opening (32) provided above the walls of the room outside of a designated work area in the room. The supplied is conducted towards a sloping flow director (20) arranged at the second exhaust opening (32).

13 Claims, 3 Drawing Sheets

METHOD AND DEVICE FOR VENTILATING A SO CALLED CLEAN ROOM

SCOPE OF THE INVENTION

The invention concerns a method and device for ventilating a room with ceiling and walls, whereby clean air is conducted to at least a portion of the room from the ceiling through a first air stream.

Rooms of this type for which the invention is especially suitable occur above all within the area of health care but also within certain industries in the form of so-called clean rooms. Clean rooms are used for the production of integrated circuits, among other purposes, where the prevention of the occurrence of dust particles in the proximity of certain surfaces of materials can be decisive. In the area of health care the concern is primarily with operating rooms and similar, in which the number of air-borne particular contaminants that may carry bacteria must be kept down.

STATE OF THE ART

Methods have been developed according to which air is conducted to smaller portions of the room through directed air streams. This, however, risks ancillary injection of insufficiently purified air.

A system that to a certain degree avoids problems of additional injected air is shown and described in the WO86/06460 system. The system comprises a horizontal ceiling unit from which clean air is conducted to a space, and a vertical wall unit from which air is conducted substantially horizontally. Between the ceiling unit and the wall unit additional air outlet devices are located in order to bring about a diagonally directed air supply downwards in the form of an air curtain. The air curtain decreases the risk that air with undesirable particles is carried along with the stream of clean air.

With the embodiment according to WO86/06460 turbulence can occur at the intersections between the room's walls and ceiling. A certain risk thus remains that air passing over the floor of the room will pick up particles that are directed into the air stream along with clean air. Turbulence can, for example, lead to contact of the air stream with the floor and other dirty surfaces and then mix with an air stream with clean air.

Another prior art document is U.S. Pat. No. 4,693,175, which discloses a clean room system having fan filter units. A main supply air duct is connected to each fan filter unit through a branched supply duct to which a branched return duct is connected such as to introduce a part of the return air from the room in the main return duct. Thus, to each fan filter unit are introduced open air conditioned by an air conditioner and a part of the return air from the clean room.

THE INVENTION IN SUMMARY

One object of the present invention is to provide a method of circulation in a room, whereby the risk of contaminated air mixing with the clean air is further decreased. Another object is to provide a device designed for ventilation of a room that is embodied so that the risk that contaminated air mixing with the clean air is further decreased.

These objects are achieved in that the invention has received the special features cited in the independent patent claims.

According to the invention a portion of a room is supplied with air from above, preferably from the underside at the ceiling. Air exiting from the room is to a great extent exhausted through discharge openings at the level of the floor, but a portion thereof is exhausted along at least one of the walls of the room. The portion of the air that is not directly exhausted through the floor openings leaves the room through a discharge opening along the wall of the room.

In an embodiment according to the invention an air output device is located on the ceiling of the room. The air output device is designed with a substantially smooth underside and with diagonal side surfaces turned towards the walls. Both the underside and the side surfaces comprise perforated portions through which the clean air is conducted into the room.

Between the air output device and the sidewalls of the room, discharge openings are located at ceiling height through which air exiting the room is exhausted. In a preferred embodiment, the discharge openings are located along all the sidewalls of the room.

Between the air output device and the discharge openings, diagonally placed and curved flow directors are located that direct the clean air streaming out from the air output device downward. The flow directors to a great extent also prevent the out-flowing air from being directly exhausted through the discharge openings.

The term 'clean air' is understood here as air purified of particles as well as sterilized or disinfected air.

Further advantages and special features of the invention can be seen in the following description, dependent patent claims, and accompanying drawings.

BRIEF DESCRIPTION OF THE DRAWINGS

The invention will now be described in more detail with the aid of examples of embodiments and with reference to attached drawings, on which

DESCRIPTION OF THE KNOWN PRIOR ART

Figure 1:
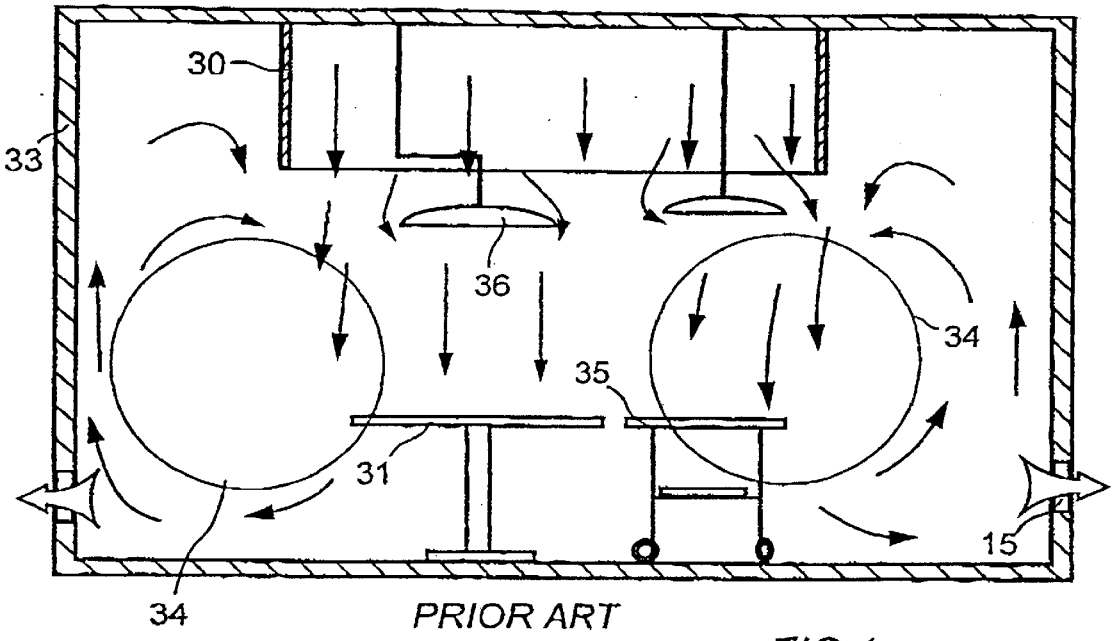
FIG. 1 is a schematic perspective view of a previously known embodiment of a device for ventilation of a room.

A presently known system for room ventilation in an operating room is shown in FIG. 1. In the operating room an air supply device 30 is located centrally on the ceiling. The air supply device has a vertical extension down into the room in order in that way to control the air supply towards the central portion of the room where an operating table 31 is placed. The discharge air device is located at discharge openings 15 in two opposing walls at the level of the floor. Clean air is supplied to the room via air supply device 30 at a relatively high flow velocity. Systems of this known type rely on a very high turnover of air. There are systems that provide 400 exchanges of air per hour and thus require a very high flow velocity.

The air has a relatively high flow velocity also when it approaches the floor of the room, and turbulence easily occurs. A great amount of the air supplied leaves the room in the desired manner through discharge device 15. The air that is exhausted creates a negative pressure at air supply device 30. The negative pressure ensures that air that may have passed over the floor and taken up particles carrying bacteria is exhausted along the sidewalls of the room. This air can be contaminated and the risk exists that this air may be drawn along with the downwardly directed air stream and thus be contaminated.

As a result of the high airflow velocity greater turbulence occurs at the floor of the room near sidewalls 33. This turbulence causes particles and contamination from the floor of the room to be drawn along in the air stream. The contaminated air can enter into the air stream coming directly from air supply device 30 and thus reach undesired portions of the room, for example the areas marked with circles 34. In the first place, the spaces at a certain distance from operating table 31 can be reached, for example a space in which a side table or tool table 35 is placed. Sterile tools and similar can be located on the tool table, and these could very well be contaminated by the circulating air.

The high airflow velocity also leads to turbulence around objects and personnel in the room. Operating lamps 36 and similar located on the ceiling can cause strong turbulence that further increases the risk of undesirable vortices.

Figure 2:
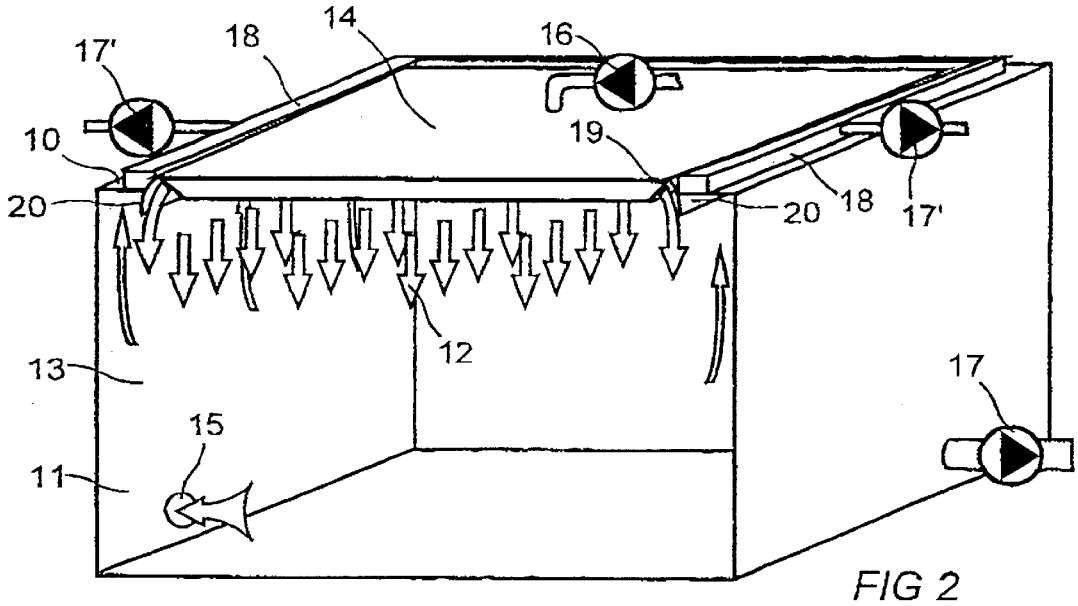
FIG. 2 is a schematic perspective view of an embodiment of a device for ventilation of a room according to the invention.

The room shown schematically in FIG. 2 comprises an embodiment of a device according to the invention for room ventilation and is an operating room but could be a clean room in an industrial setting. The room is embodied with ceiling 10 that at least in part is made up of or comprises a device for air delivery in the form of air output device 14 extending down from the ceiling, and walls 11. Clean air is directed from the air output device in a first air stream 12 toward selected portions of the room. The clean air is directed in such a way that it spreads out at a relatively low flow velocity. The flow velocity is preferably lower than 1 m/s and more preferably as low as 0.2 m/s. The room ventilation according to the invention normally provides about 20 air exchanges per hour. Higher and lower values of air exchange also occur. The low flow velocity means that the risk of turbulence and vortices is very low. Air is exhausted from the room via a second air stream 13 through first discharge openings 15 in the walls 11 of the room at or near the floor.

The clean inlet air is supplied to air output device 14 under positive pressure that is provided by at least one positive pressure pump device 16. Evacuation of discharge air is accomplished through at least a second negative pressure pump device 17. Two ventilation fans or pump devices 17 are preferably located diagonally towards each other in two opposing walls. In the embodiment shown, two further ventilation fans or pump devices 17' for the creation of negative pressure are connected with box-shaped channel systems 18 running along walls 11. Channel systems 18 are embodied with slits or openings on the underside through which the air is evacuated from the room (see also FIG. 3 and FIG. 4). Approximately 80–85% of the air is preferably evacuated through the first discharge openings 15 located at the floor.

Supply air is discharged into the room through openings in air output device 14. Air output device 14 is preferably embodied with perforated portions that are placed over the areas in the room that will be supplied with clean air. The air that is supplied through these perforated portions is given an essentially vertical direction downwards in an air stream 12. The air output device is embodied with side surfaces 19 that are diagonally oriented towards the adjacent wall through which air supply is directed diagonally downwards into the room. In order further to control and direct this supply air, flow directors 20 are located between wall 11 and side surface 19.

Figure 3:
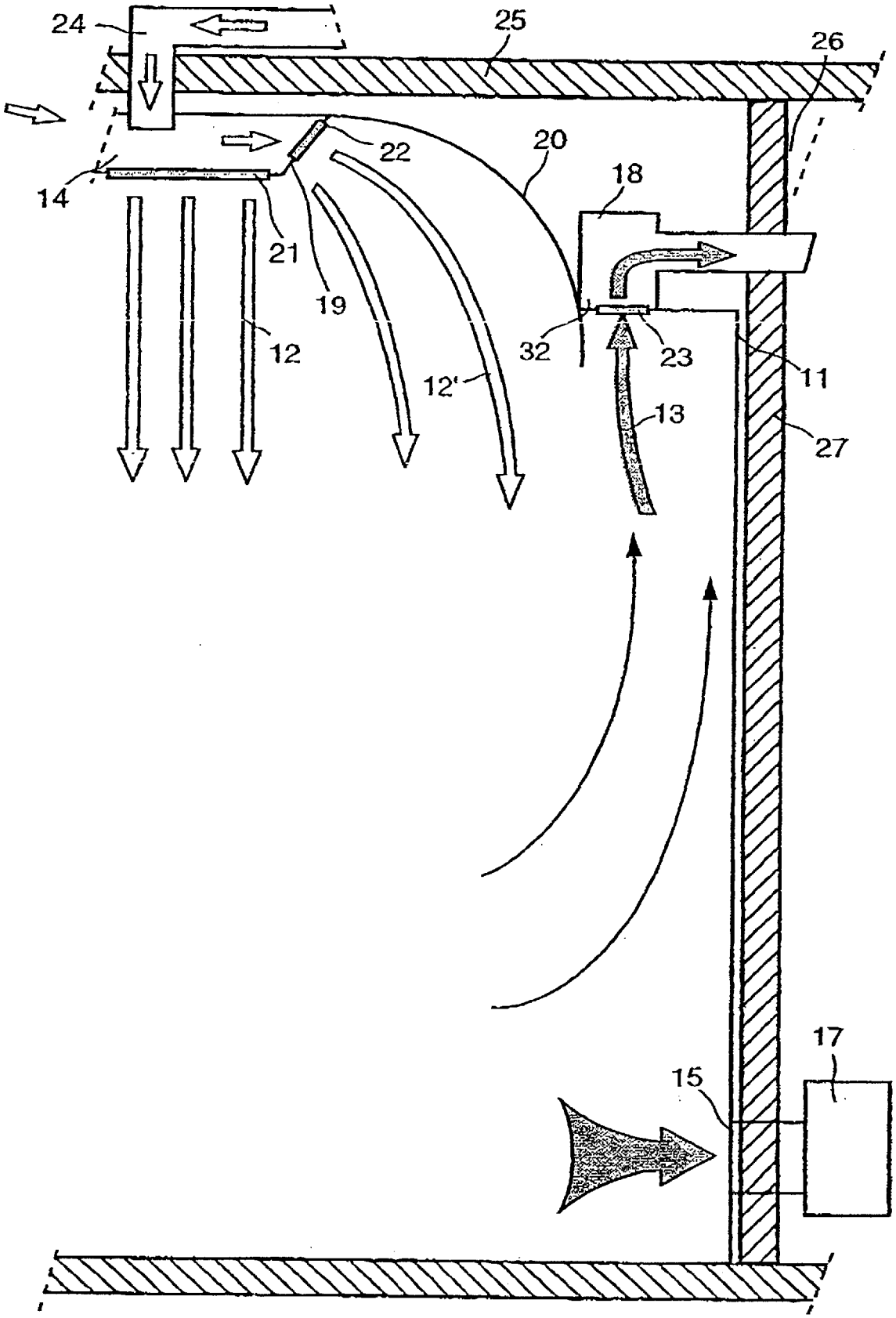
FIG. 3 is a schematic perspective view of a portion of the device according to FIG. 2.

FIG. 3 shows more clearly how the airflows at wall 11 are developed as a result of the controlled supply and evacuation of air. First air stream 12 spreads essentially vertically downward from a first perforated panel 21 in air output device 14. A part 12' of first air stream 12 also spreads from a second perforated panel 22 in the side surface of air output device 19. This part 12' of the first air stream is directed toward wall 11 diagonally downward by flow director 20. In the embodiment shown, flow director 20 is embodied as a curved plate that extends over the length of the whole room. Corresponding plates are preferably located at all of walls 11 in the room.

The clean air is directed to perforated panels 21 and 22 through first tubing 24 from the positive pressure pump device 16. First tubing 24 extends in the embodiment shown through a ceiling and or floor structure 25. Supply of clean air to perforated panels 21 and 22 can occur through air output device 14, or through special tubing, for example in the manner that is indicated in FIG. 3.

The box-formed channel system 18 suitably also extends over the whole length of all walls. There may be special reasons to limit the extent of channel system 18 over certain portions. Channel system 18 is provided at the end turned toward the room with at least a third perforated panel 23 through which air is discharged from the room. The perforated portions constitute the second discharge openings 32. Depending on the shape of the room, furnishings, and requirements of cleanliness, the size and number of perforated panels 23 can vary.

A second tubing 26 leads from channel system 28, through which outlet air is evacuated with aid of second pump device 17 (see FIG. 2). Second tubing 26 extends through an outer wall or bearing wall 27 toward the exterior or another space. Second pump device 17 is preferably placed outside outer wall 27.

The flow director 20 has an extension such that air from first air stream 12, 12' is directed to a parallel but oppositely oriented direction of flow in relation to the direction of flow taken by second air stream 13. By controlling the air streams the risk of causing turbulence and vortices is decreased. Contaminated air will instead be forced out towards the walls of the room and up along the walls toward second discharge openings 32. Flow director 20 extends vertically below second discharge openings 32 so that undesired turbulence at discharge openings 32 is avoided. By means of the differing function of flow director 20, entry of bacteria-bearing particles and other particles can be prevented in first air stream 12.

Figure 4:
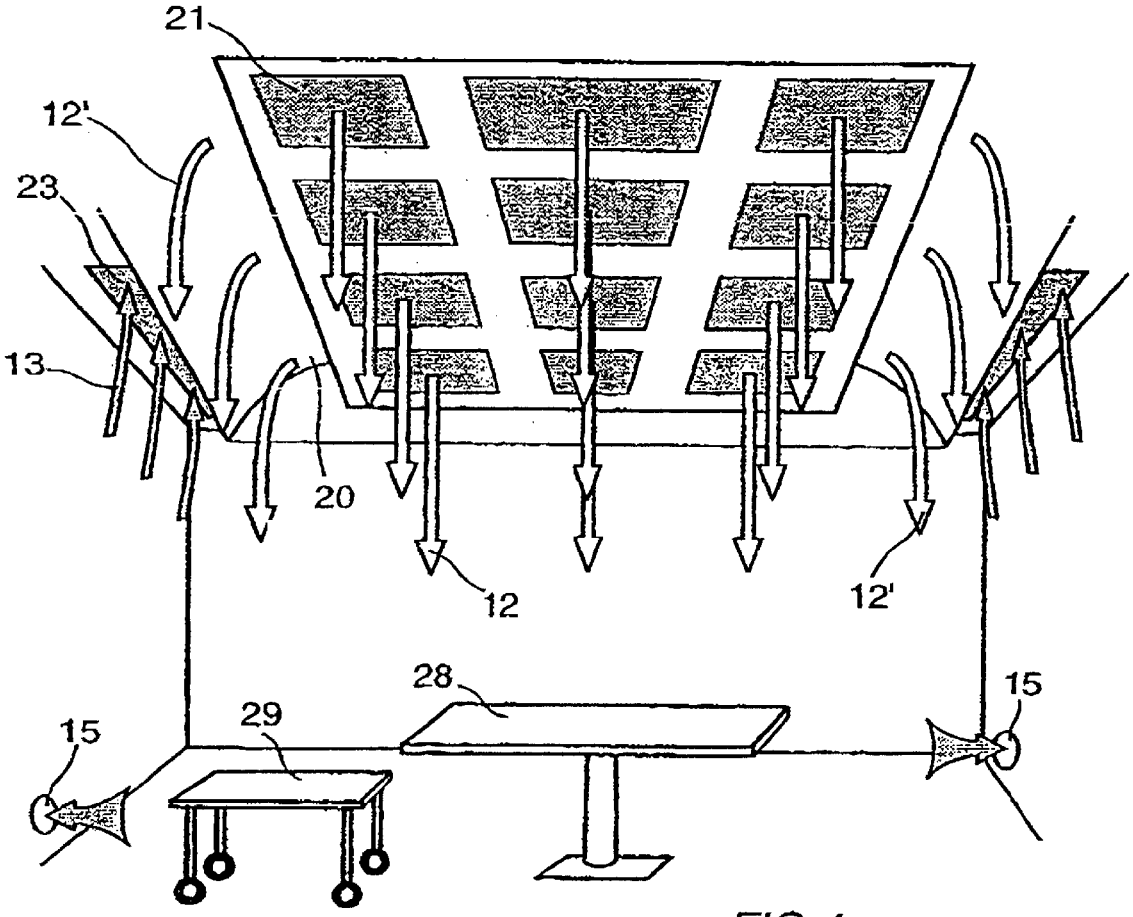
FIG. 4 is a schematic perspective view from below of the embodiment in FIG. 2.

FIG. 4 shows an example of how first air stream 12 spreads from a number of first perforated panels 21. The number of panels 21 and their placement can vary depending on the current application and the design of the room. Air output device 14 located on the ceiling can, as in the embodiment shown, cover the whole ceiling of the room. By this means, the whole room can in principle be supplied with clean air. Only the area closest to the walls of the room lacks a clean air supply. In other embodiments, the air output device covers only a part of the ceiling. It is also possible to cover the whole ceiling or some part thereof with several coordinated air output devices.

An operating table 28 located in the central portion of the room and a tool table 29 or similar located at a certain distance from the sidewall of the room are supplied with clean air through the device according to the invention. The risk that contaminated air can enter the air stream with clean air is kept very low. Tool table 29 and similar furnishings can thus be placed rather at random in the room with a low risk of being contaminated by dirty air.

Ceiling-mounted equipment for use in the room can be attached in air output device 14 or, where suitable, in ceiling structure 25. Operating equipment and other sensitive equipment should be located at a distance from the walls of the room.

The ventilation of the room is completely controlled with a supply of clean air under positive pressure and discharge of used air. Through adjustment of the surface through which clean air is supplied to the room, an arbitrary surface or area in the room can achieve the desired degree of cleanliness.

What is claimed is:

1. A method for ventilation of a room with walls and a ceiling, clean air being conducted to at least a portion of the room through a first air stream, and air being exhausted through first discharge openings arranged in the walls of the room comprising the steps of:

exhausting air contained in a second air stream along at least one wall from the room through at least a second discharge opening provided above the walls of the room outside of a designated work area in the room, and supplying the air of the first air stream towards a sloping flow director arranged at the second discharge opening.

2. A method according to claim 1, wherein the air of the first stream is guided downwards in the room, so that the first air stream closest to at least one wall is assigned a flow direction which is parallel with and opposed to a second flow direction of the second air stream.

3. A method according to claim 2, wherein the first air stream is conducted to the room through at least one air output device which is extending down from the ceiling.

4. A device for ventilation of a room with walls and a ceiling, a positive pressure pump device generating a positive pressure is provided for supply of clean air to at least a portion of the room from the ceiling through a first air stream, and at least a first negative pressure pump device generating a negative pressure is arranged to evacuate used air from the room through a first discharge opening, comprising at least a second negative pressure pump device generating a negative pressure is provided to evacuate air which has circulated in the room, at least a second discharge opening is provided above the walls of the room outside of a work area in the room to evacuate used air through said second negative pressure pump device creating a negative pressure, a flow director is arranged at the second discharge opening to guide the partial amount of said first air stream at an inclined angle towards the walls of the room.

5. A device according to claim 4, further comprising air output devices provided on the ceiling of the room to deliver clean air vertically down into the first air stream and at least in the direction of one of the walls of the room in a partial amount of said first air stream.

6. A device according to claim 4, wherein said output devices are arranged to be extending down from the ceiling of the room.

7. A device according to claim 5, wherein said air output devices are connected to said pump device creating a positive pressure, and said first discharge opening is connected to said first negative pump device creating a negative pressure to evacuate a substantial amount of the air supplied.

8. A device according to claim 5, wherein said air output device comprises at least a perforated portion.

9. A device according to claim 4, wherein a channel system is provided adjacent the ceiling of the room along at least one of the walls of the room, at least one opening in the channel system constitutes said second discharge opening, and said channel system is connected to a second negative pressure pump device creating a negative pressure.

10. A device according to claim 4, wherein said positive pressure pump device is provided to supply air to the room at a flow rate lower than 1 meter/sec.

11. A device according to claim 4, wherein said positive pressure pump device is provided to supply air to the room at a flow rate of approximately 0.2 meter/sec.

12. A device according to claim 4, wherein said second discharge opening is connected to said second negative pressure pump device creating a negative pressure to evacuate a smaller amount of the air supplied.

13. A device according to claim 12, wherein said first negative pressure pump device is provided to evacuate approximately 80% of the air supplied, and said second negative pressure pump device is provided to evacuate approximately 20% of the air supplied.

* * * * *